US005919272A

United States Patent [19]

Nielsen

[11] Patent Number: 5,919,272

[45] Date of Patent: Jul. 6, 1999

[54] PROCESS FOR PROVIDING LOCALIZED VARIATION IN THE COLOR DENSITY OF FABRICS

[75] Inventor: Jack Bech Nielsen, Hellerup, Denmark

[73] Assignee: Novo Nordisk A/S, Bagsvaerd, Denmark

[21] Appl. No.: 08/507,286

[22] PCT Filed: Feb. 25, 1994

[86] PCT No.: PCT/DK94/00078

§ 371 Date: Sep. 18, 1995

§ 102(e) Date: Sep. 18, 1995

[87] PCT Pub. No.: WO94/19528

PCT Pub. Date: Sep. 1, 1994

[30] Foreign Application Priority Data

Feb. 26, 1993 [DK] Denmark ..... 0212/93

[51] Int. Cl.[6] ..... C09B 67/00

[52] U.S. Cl. ..... 8/401; 8/102; 8/116.1; 435/263

[58] Field of Search ..... 435/263, 188, 435/209, 264; 8/401

[56] References Cited

U.S. PATENT DOCUMENTS

| | | | |
|---|---|---|---|
| 4,912,056 | 3/1990 | Olson | 435/263 |
| 5,213,581 | 5/1993 | Olson et al. | 8/401 |
| 5,290,474 | 3/1994 | Clarkson et al. | 252/174.12 |
| 5,538,648 | 7/1996 | Buchelet et al. | 8/111 |

*Primary Examiner*—David A. Redding
*Attorney, Agent, or Firm*—Steve T. Zelson, Esq.; Valeta Gregg, Esq.

[57] ABSTRACT

A process for providing improved localised variation in the color density of the surface of dyed fabrics by reducing backstaining, the process including treating a dyed fabric with a cellulytic enzyme in an aqueous liquor and adding a sufficient amount of chelating agent to the liquor to reduce the concentration of di- or trivalent cation to less than 20 mg/l.

26 Claims, 1 Drawing Sheet

PROCESS FOR PROVIDING LOCALIZED VARIATION IN THE COLOR DENSITY OF FABRICS

CROSS-REFERENCE TO RELATED APPLICATIONS

This application is a continuation of PCT/DK94/00078 filed Feb. 25, 1994, which is incorporated herein by reference.

FIELD OF INVENTION

The present invention relates to processes of providing localized variation in the colour of dyed fabrics.

BACKGROUND OF THE INVENTION

The most usual method of providing a "stone-washed" look (localized abrasion of the colour) in dyed fabrics, in particular cellulose-containing fabrics, is by washing cellulose-containing fabrics or clothing made from such fabrics in the presence of pumice stones to provide the desired localized lightening of the colour of the fabric. Using pumice for this purpose has the disadvantage that pumice particles have to be washed from the fabric or clothing subsequently to treatment, and that the pumice stones and particles cause a significant wear of the machines used in the process. Also, handling large amounts of stones may be a problem.

Other approaches to providing a "stone-washed"appearance to fabrics have therefore been suggested. For instance, enzymes, in particular cellulytic enzymes, have been suggested for this purpose, either alone (4,832,864 or together with a smaller amount of pumice than required in the traditional process.

SUMMARY OF THE INVENTION

The present invention is based on the surprising finding that it is possible to obtain improved utilization of the ability of cellulytic enzymes to provide localized colour variations in dyed fabrics either by adding a chelating agent to a wash liquor containing calcium ions and other di- or trivalent cations, or by carrying out the process in soft water.

Accordingly, the present invention relates to a process for providing improved localised variation in the colour density of the surface of dyed fabrics, the process comprising treating a dyed fabric with a cellulytic enzyme in an aqueous liquor comprising a di- or trivalent cation and a chelating agent in a molar ratio of 1:0.1–50.

In another aspect, the present invention relates to a process for providing improved localised variation in the colour density of the surface of dyed fabrics, the process comprising treating a dyed fabric with a cellulytic enzyme in an aqueous liquor comprising less than 20 mg/l of $Ca^{2+}$ and $Mg^{2+}$.

In the present context, the expression "improved localized variation" is intended to indicate that the differences between lighter and darker areas of the fabrics is more pronounced than in fabrics treated by the enzymatic process described in, e.g. U.S. Pat. No. 4,832,864. It has been found that in the known enzymatic "stone-washing" processes for obtaining localized colour variations, at least some (though not all) of the dye washed from the fabric is redeposited thereon so that the difference between darker and lighter shades on the fabric is somewhat obscured (this phenomenon is known as backstaining to people skilled in the art). It has surprisingly been found that by reducing the amount of free calcium or other di- or trivalent cations in the liquor in which the fabric is treated (e.g. by the addition of a chelating agent to calcium-containing water or by using soft water), such redeposition of dye may be significantly reduced.

DETAILED DESCRIPTION OF THE INVENTION

Figure 1:
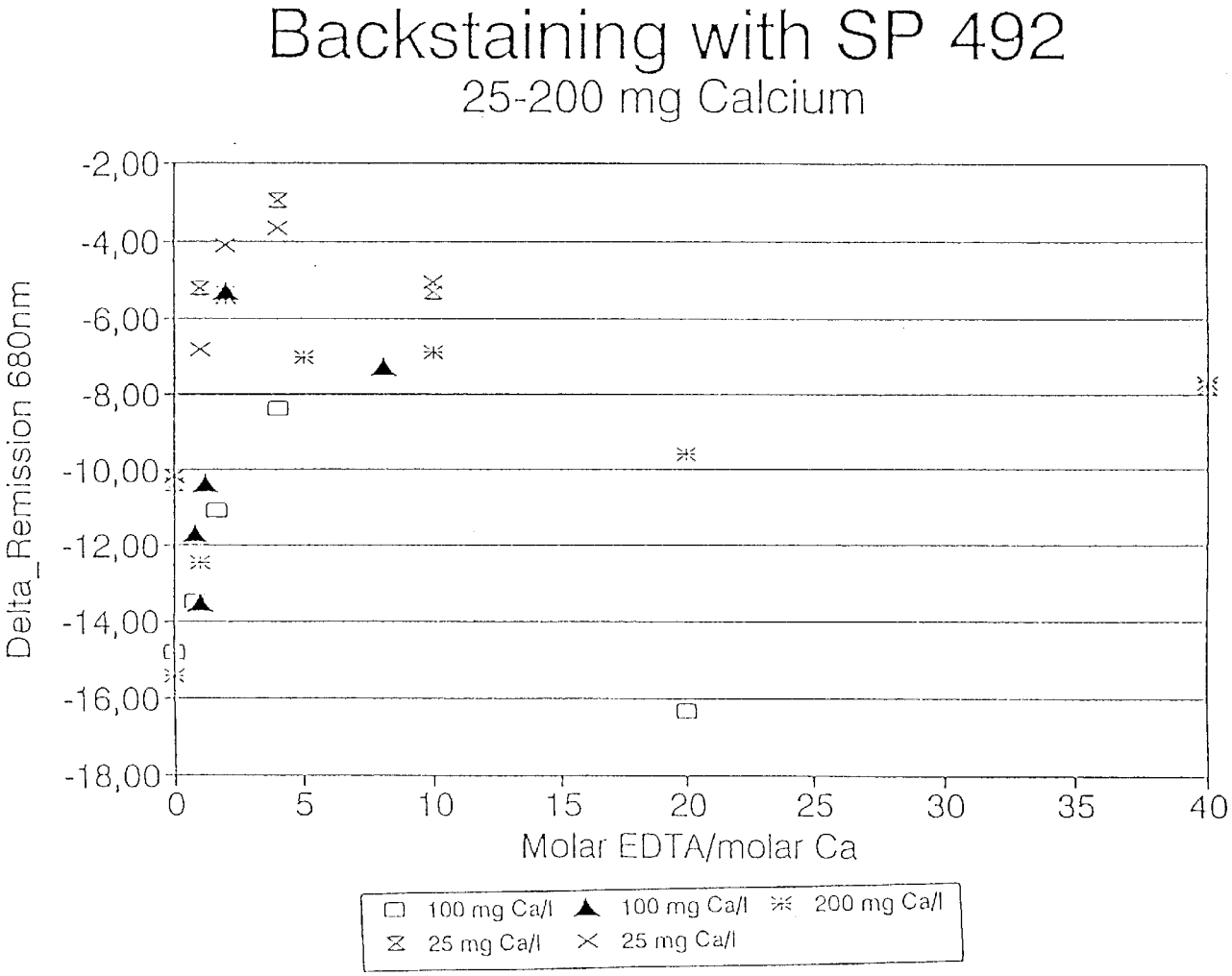
FIG. 1 illustrates the effects of backstaining at various concentrations of cations in the wash liquor.

The di- or trivalent cations present in the wash liquor may be alkaline earth metal ions, in particular $Ca^{2+}$ or $Mg^{2+}$. According to the invention, the molar ratio between di- or trivalent ions and chelating agent depends on the nature of the chelating agent. However, a currently preferred ratio of di- or trivalent cations (such as $Ca^{++}$) to chelating agent is 1:0.1–10, more preferably, 1:0.2–5.

Fabrics:

The process of the invention is most beneficially applied to cellulose-containing fabrics, such as cotton, viscose, rayon, ramie, linen, Tencel or mixtures thereof, or mixtures of any of of these fibres with synthetic fibres. In particular, the fabric is denim. The fabric may be dyed with vat dyes such as indigo, direct dyes such as Direct Red 185, sulphur dyes such as Sulfur Green 6, or reactive dyes fixed to a binder on the fabric surface. In a most preferred embodiment of the present process, the fabric is indigo-dyed denim, including clothing items manufactured therefrom.

Cellulytic enzymes:

The cellulytic enzyme employed in the process of the invention may be any cellulase previously suggested for this, purposes (e.g. as, described, in U.S. Pat. No. 4,832,864). Thus, the cellulytic enzyme may be a fungal or bacterial cellulase. According to the invention, it has been found that both acid and neutral or alkaline cellulases may be employed (the selection of the chelating agent will, however, depend on the type of cellulase used). Examples of suitable acid cellulases are those derivable from a strain of Trichoderma, Irpex. Clostridium or Thermocellum sp. Examples of suitable neutral or alkaline cellulases are those derivable from a strain of Humicola, Fusarium, Bacillus, Cellulomonas, Pseudomonas, Myceliophthora or Phanerochaete sp. Preferred cellulases may be obtained from *Humricola insolens*. A currently preferred cellulase is a 43 kD endoglucanase obtainable from *Humicola insolens* (e.g. described in WO 91/17243).

Chelating agent:

According to the present invention, the chelating agent may be one which is soluble and capable of forming complexes with di- or trivalent cations (such as calcium) at acid, neutral or alkaline pH values. As indicated above, the choice of chelating agent depends on the cellulase employed in the process. Thus, if an acid cellulase is included, the chelating agent should be one which is soluble and capable of forming a complex with di- or trivalent cations at an acid pH. If, on the other hand, the cellulase is neutral or alkaline, the chelating agent should be one which is soluble and capable of forming a complex with di- or trivalent cations at a neutral or alkaline pH.

The chelating agent may suitably be selected from aminocarboxylic acids; hydroxyaminocarboxylic acids; hydroxycarboxylic acids; phosphates, di-phosphates, tripolyphosphates, higher poly-phosphates, pyrophosphates; zeolites; polycarboxylic acids; carbohydrates, including polysaccharides; hydroxypyridinones; organic compounds comprising catechol groups; organic compounds comprising hydroxymate groups; silicates; or polyhydroxysulfonates.

When the chelating agent is an aminocarboxylic acid, it may suitably be selected from EDTA (ethylene diamine tetra-acetic acid), DTPA (diethylene triamine pentaacetic acid), NTA (nitrilo triacetic acid), CDTA (trans-1,2-diaminocyclohexane-N,N,N',N'-tetraacetic acid), EGTA (ethyleneglycol-O,O'-bis(2-aminoethyl)-N,N,N',N'-tetratraacetic acid), or TTHA (triethylenetetraamine-N,N,N',N'-hexaacetic acid).

When the chelating agent is a hydroxyaminocarboxylic acid, it may suitably be selected from HEDTA (hydroxyethylene diamine triacetic acid), DEG/DHEG (dihydroxyethyl glycine), or HEIDA (N-(2-hydroxyethyl)-iminodiacetat).

When the chelating agent is a hydroxycarboxylic acid, it may suitably be selected from gluconic acid, citric acid, tartaric acid, oxalic acid, diglycolic acid, or glucoheptonate.

When the chelating agent is a polyamino- or polyhydroxyphosphonate or -polyphosphonate, it may suitably be selected from PBTC (phosphonobutantriacetat), ATMP (aminotri(methylenphosphonic acid)), DTPMP (diethylene triaminpenta(methylenphosphonic acid), EDTMP ethylene diamintetra (methylenphophonic acid)), HDTMP (hydroxyethylethylendiamintri(methylenphosphonic acid)), HEDP (hydroxyethane diphosphonic acid), or HMDTMP (hexamethylen-diamine tetra(methylene phosphonic acid)).

When the chelating agent is a polycarboxylic acid (or a mixture of polycarboxylic acids), it may suitably be selected from water soluble salts of homo- and copolymers of aliphatic carboxylic acids such as maleic acid, itaconic acxid, mesaconic acid, fumaric acid, aconitic acid, citraconic acid and methylenemalonic acid; carboxymethyloxymalonate, carboxymethyloxysuccinate, ciscyclohexanehexacarboxylate, ciscyclopentanetetracarboxylate, phloroglucinol trisulfonate; polyacetal carboxylates.

Suitably polycarboxylic acids may be selected from polyacrylate, polymaleate, maleic-methylvinylethercopolymers, maleic-acrylic-copolymers, maleic-olefinecopolymers, polyvinylpyrrolidone, polyoxymethylcarboxylates, poly(O-hydroxy-acrylate), poly[(3-hydroxymethyl)-hexamethylene-1,3,5-tricarboxyl], poly[(3-oxymethyl)-hexamethylene-1,3,5-tricarboxyl], poly[(4-methoxy)-tetramethylene-1,2-dicarboxylate], poly-(tetramethylene-1,2-dicarboxylate), poly(vinyl methyl ether-maleic anhydride), MW 20.000–80.000, carboxymethyloxymalonate, carboxymethyloxysuccinate, or 1,2,3,4-Cyclopentane-tetracarboxylic acid.

Buffer:

It has been experimentally established that particularly advantageous results may be obtained in the process of the invention when the wash liquor additionally comprises a buffer.

The buffer may suitably be a phosphate, borate, citrate, acetate, adipate, triethanolamine, monoethanolamine, diethanolamine, carbonate (especially alkali metal or alkaline earth metal, in particular sodium or potassium carbonate, or ammonium and HCl salts), diamine, especially diaminoethane, imidazole, or amino acid buffer.

Dispersing agent:

Likewise, it has been experimentally established that particularly favourable results may be obtained in the process of the invention when the wash liquor additionally comprises a dispersing agent.

The dispersing agent may suitably be selected from nonionic, anionic, cationic, ampholytic or zwitterionic surfactants. More specifically, the dispersing agent may be selected from carboxymethylcellulose, hydroxypropylcellulose, alkyl aryl sulphonates, long-chain alcohol sulphates (primary and secondary alkyl sulphates), sulphonated olefins, sulphated monoglycerides, sulphated ethers, sulphosuccinates, sulphonated methyl ethers, alkane sulphonates, phosphate esters, alkyl isethionates, acyl sarcosides, alkyl taurides, fluorosurfactants, fatty alcohol and alkylphenol condensates, fatty acid condensates, condensates of ethylene oxide with an amine, condensates of ethylene oxide with an amide, block polymers (polyethylene glycol, polypropylene glycol, ethylene diamine condensed with ethylene or propylene oxide), sucrose esters, sorbitan esters, alkyloamides, fatty amine oxides, ethoxylated monoamines, ethoxylated diamines, ethoxylated polyamines, ethoxylated amine polymers and mixtures thereof.

The invention is illustrated in further detail in the following example.

EXAMPLE 1

Backstaining on treating denim fabric with a *H. insolens* 43 kD cellulase preparation was determined at three different levels of $Ca^{2+}$ and different concentrations of EDTA. The Launder-O-Meter model was used in all trials. In each of the five trials, the $Ca^{2+}$ concentration was kept constant in all 20 beakers. Three levels of $Ca^{2+}$ were used.

25 mg $Ca^{2+}$/l (two identical trials)

100 mg $Ca^{2+}$/l (two trials, different EDTA/$Ca^{2+}$ ratios)

200 mg $Ca^{2+}$/l (one trial)

The trials were run under the following conditions:

Temperature: 55° C.

Time: 120 minutes

Fabric: 5.0 g of Swift denim, 2 swatches (approx. 7×7 cm) of white mercerizised 100% cotton Mechanical effect: 1 large rubber ball Enzyme: SP 492: Humicola insolens 43 kD endoglucanase (cf. WO 91/17243), approx. 0.46 g/beaker (about 100 ECU*/beaker)

Liquid: 150 ml

Standard solutions of 20 mg $Ca^{2+}$/ml (as $CaCl_2.2H_2O$) and 0.6M EDTA (sodium salt, pH 7) were prepared and used in all the trials.

Amounts of the $Ca^{2+}$ and EDTA solutions calculated to give the desired molar ratios of $Ca^{2+}$ to EDTA were pipetted into a glass beaker, and distilled water was added to 500 ml followed by mixing. The mixture was heated to 55–60° C. for 20–30 minutes and cooled to below 30° C. The pH was adjusted to 6.9–7.1 with 1N NaOH or 1N HCl after addition of the enzyme (1.5 ml enzyme/500 ml).

150 of this mixture was weighed out in each beaker. The beakers were placed in the Launder-O-Meter, and trials were run for 120 minutes.

The white fabric was rinsed thoroughly in distilled water. Fabric from different beakers was rinsed separately. The remission from the white fabric was measured on an Elrepho-photometer.

The results are shown in FIG. 1. It appears from FIG. 1 that backstaining is dependent on the concentration of $Ca^{2+}$. Increasing concentrations of $Ca^{2+}$ lead to increased backstaining. Addition of EDTA results in decreased backstaining. At a molar ratio of $Ca^{2+}$ to EDTA of 1:2–4, backstaining is at its minimum (at pH 7).

(* The endoglucanase activity is determined as the viscosity decrease of a solution of carboxymethyl cellulose (CMC) after incubation with the enzyme under the following conditions:

A substrate solution is prepared, containing 35 g/l CMC (Hercules 7 LFD) in 0.1M tris buffer at pH 9.0. The enzyme sample to be analyzed is dissolved in the same buffer.

10 ml substrate solution and 0.5 ml enzyme solution are mixed and transferred to a viscosimeter (e.g. Haake VT 181, NV sensor, 181 rpm), thermostated at 40° C.

Viscosity readings are taken as soon as possible after mixing and again 30 minutes later. The amount of enzyme that reduces the viscosity by one half under these conditions is defined as 1 ECU).

I claim:

1. A method of reducing redeposition or backstaining of dye on dyed cellulose-containing fabric subjected to enzymatic stone-washing with a wash liquor containing cellulase, comprising reducing the concentration of di- or trivalent cation in the wash liquor to less than 20 mg/l.

2. The method of claim 1, wherein the divalent cation is $Ca^{2+}$ or $Mg^{2+}$.

3. The method of claim 2, wherein the $Ca^{2+}$ concentration is reduced by the addition of a sufficient amount of a chelating agent to the wash liquor.

4. The method of claim 3, wherein the chelating agent is soluble and forms a complex with the cation at acid, neutral or alkaline pH values.

5. The method of claim 4, wherein the chelating agent is selected from aminocarboxylic acids; hydroxyaminocarboxylic acids; hydroxycarboxylic acids; phosphates, di-phosphates, tri-polyphosphates, higher poly-phosphates, pyro-phosphates; zeolites; polycarboxylic acids; carbohydrates, including polysaccharides; hydroxypyridinones; organic compounds comprising catechol groups; organic compounds comprising hydroxymate groups; silicates; or polyhydroxysulfonates.

6. The method of claim 5, wherein the chelating agent is an aminocarboxylic acid selected from EDTA (ethylene diamine tetra-acetic acid), DTPA (diethylene triamine penta-acetic acid), NTA (nitrilo triacetic acid), CDTA (trans-1,2-diaminocyclohexane-N,N,N',N'-tetraacetic acid), EGTA (ethyleneglycol-O,O'-bis(2-aminoethyl)-N,N,N',N'-tetraacetic acid), or TTHA (triethylenetetraamine-N,N,N',N'-hexaacetic acid).

7. The method of claim 5, wherein the chelating agent is a hydroxyaminocarboxylic acid selected from HEDTA (hydroxyethylene diamine triacetic acid) DEG/DHEG (dihydroxyethyl glycine), or HEIDA (N-(2-hydroxyethyl)-iminodiacetat).

8. The method of claim 5, wherein the chelating agent is a hydroxycarboxylic acid selected from gluconic acid, citric acid, tartaric acid, oxalic acid, diglycolic acid, or glucoheptonate.

9. The method of claim 5, wherein the chelating agent is selected from the group consisting of PBTC (phosphonobutantriacetat), ATMP (aminotri (methylenphosphonic acid)), DTPMP (diethylene triaminpenta-(methylenphosphonic acid), EDTMP ethylene diamintetra-(methylenphophonic acid)), HDTMP (hydroxyethylethylendiamin-tri(methylenphosphonic acid)), HEDP (hydroxyethane di-phosphonic acid), and HMDTMP (hexamethylen-diamine tetra-(methylene phosphonic acid)).

10. The method of claim 5, wherein the chelating agent is a polycarboxylic acid selected from the group consisting of maleic acid, itaconic acxid, mesaconic acid, fumaric acid, aconitic acid, citraconic acid, methylenemalonic acid, carboxymethyloxy-malonate, carboxympthyloxysuccinate, cis-cyclohexanehexa-carboxylate, ciscyclopentanetetracarboxylate, phloroglucinol trisulfonate, and polyacetal carboxylates.

11. The method of claim 10, wherein the polycarboxyl-ic acid is selected from the group consisting of polyacrylate, polymaleate, maleic-methylvinylether-copolymers, maleic-acrylic-copolymers, maleic-olefine-copolymers, polyvinylpyrrolidone, polyoxymethylcarboxylates, poly(Ó-hydroxy-acrylate), poly[(3-hydroxymethyl)-hexamethylene-1,3,5-tricarboxyl], poly[(3-oxymethyl)-hexamethylene-1,3,5-tricarboxyl], poly-[(4-methoxy)-tetramethylene-1,2-dicarboxylate], poly-(tetra-methylene-1,2-dicarboxylate), poly(vinyl methyl ether-maleic anhydride), carboxymethyloxymalonate, carboxymethyloxysuccinate, and 1,2,3,4-cyclopentane-tetra-carboxylic acid.

12. The method of claim 11, wherein the cellulase is a fungal or bacterial cellulase.

13. The method of claim 12, wherein the cellulase is an acid cellulase.

14. The method of claim 13, wherein the acid cellulase is from a strain of Trichoderma, Irpex, Glostridium or Thermocellum.

15. The method of claim 3, wherein the cellulase is a neutral or alkaline cellulase.

16. The method of claim 15, wherein the cellulase is derived from a strain of Humicola, Fusarium, Bacillus, Cellulomonas, Pseudomonas, Myceliophthora or Phanerochaete.

17. The method of claim 1, wherein the liquor further comprises a buffer.

18. The method of claim 17, wherein the buffer is a phosphate, borate, citrate, acetate, adipate, triethanolamine, monoethanolamine, diethanolamine, carbonate, diamine, diaminoethane, imidazole, or amino acid buffer.

19. The method of claim 18, wherein the carbonate is sodium carbonate, potassium carbonate, ammonium carbonate, or chloride carbonate.

20. The method of claim 11, wherein the wash liquor further comprises a dispersing agent.

21. The method of claim 20, wherein the dispersing agent is selected from nonionic, anionic, cationic, ampholytic or zwitterionic surfactants.

22. The method of claim 21, wherein the dispersing agent is selected from the group consisting of carboxymethylcellulose, hydroxypropyl-cellulose, alkyl aryl sulphonates, long-chain alcohol sulphates, sulphonated olefins, sulphated monoglycerides, sulphated ethers, sulphosuccinates, sulphonated methyl ethers, alkane sulphonates, phosphate esters, alkyl isethionates, acyl sarcosides, alkyl taurides, fluorosurfactants, fatty alcohol and alkylphenol condensates, fatty acid condensates, condensates of ethylene oxide with an amine, condensates of ethylene oxide with an amide, poly ethylene glycol, polypropylene glycol, ethylene diamine condensed with ethylene or propylene oxide, sucrose esters, sorbitan esters, alkyloamides, fatty amine oxides, ethoxylated monoamines, ethoxylated diamines, ethoxylated polyamines, ethoxylated amine polymers and mixtures thereof.

23. The method of claim 1, wherein the cellulose-containing fabric is denim.

24. The method of claim 11, wherein the cellulose-containing fabric is dyed with a vat dye, direct dye, sulphur dye or reactive dye.

25. The method of claim 3, wherein the molar ratio of di- or trivalent cation to chelating agent is 1:0.1–10.

26. The method of claim 25, wherein the molar ratio of di- or trivalent cation to chelating agent is 1:0.2–5.

* * * * *